US007444761B2

(12) United States Patent
Gray

(10) Patent No.: US 7,444,761 B2
(45) Date of Patent: Nov. 4, 2008

(54) INTRINSICALLY SAFE FLAMMABLE SOLVENT PROCESSING METHOD AND SYSTEM

(76) Inventor: Donald J. Gray, 9 McGraw Ct., Warwick, RI (US) 02818

( * ) Notice: Subject to any disclaimer, the term of this patent is extended or adjusted under 35 U.S.C. 154(b) by 0 days.

(21) Appl. No.: 11/276,575

(22) Filed: Mar. 6, 2006

(65) Prior Publication Data

US 2007/0204480 A1 Sep. 6, 2007

(51) Int. Cl.
*F26B 5/00* (2006.01)
*F26B 5/04* (2006.01)

(52) U.S. Cl. ..... 34/340; 34/348; 34/404; 34/410; 34/417; 34/423

(58) Field of Classification Search ..... 34/340, 34/348, 403, 404, 407, 409, 410, 417, 418, 34/423; 134/10, 12, 19, 21, 26, 30
See application file for complete search history.

(56) References Cited

U.S. PATENT DOCUMENTS

| | | | | |
|---|---|---|---|---|
| 6,418,942 | B1 | 7/2002 | Gray et al. | 134/1.3 |
| 6,743,300 | B2 | 6/2004 | Gray | 134/12 |
| 6,783,601 | B2 | 8/2004 | Gray et al. | 134/10 |
| 6,783,602 | B2 | 8/2004 | Gray | 134/10 |
| 6,802,137 | B1 | 10/2004 | Gray | 34/340 |
| 6,824,620 | B2 | 11/2004 | Gray et al. | 134/1 |

*Primary Examiner*—Jiping Lu
(74) *Attorney, Agent, or Firm*—Barlow, Josephs & Holmes, Ltd.

(57) ABSTRACT

Parts to be chemically treated are processed in a controlled-environment processing chamber. The process includes applying a negative gauge pressure to the chamber to remove air or other non-condensable gases. The process includes introducing an oxygen free solvent or aqueous solution in a vapor or liquid state. A first system removes oxygen and volatile contaminants from the object being processed and chamber, and a second system further recovers residual solvent from the object and chamber. Eliminating oxygen from the process prevents deflagration within the system thus allowing for the use of flammable solvents within the process.

13 Claims, 2 Drawing Sheets

INTRINSICALLY SAFE FLAMMABLE SOLVENT PROCESSING METHOD AND SYSTEM

FIELD OF INVENTION

This invention relates to an improved intrinsically safe flammable solvent processing method and system, and more particularly to a closed explosion proof processing method and system that virtually eliminates the mixture of the solvent with oxygen throughout the operation. Eliminating air and thus oxygen from the process prevents deflagration within the system thus allowing for the use of flammable solvents within the process.

BACKGROUND OF INVENTION

Composite and metal chemical processing operations are becoming more and more of a burden on industry because of the ever-stricter requirements, being made on the environmental disposition of compounds used in the operations and resulting effluents. Processing operations affected include those involving clothing, rugs and furnishings, as well as those of a more industrial nature such as involving the cleaning and treatment of metals, ceramics, plastics, semiconductors, optics and other materials. Often hazardous solvent or aqueous mixtures are used to carry out the cleaning process. This is often required since such strenuous processes such as etching, leaching, oxidizing, anodizing, or other harsh process is necessary to treat the object. This is becoming more prevalent in clean room operations where smaller parts are being manufactured requiring more thorough and consistent treatments such as in the medical, semiconductor, and microelectronics and optics areas. Processing liquids generally now require mixtures of solvents to be most effective and because of environmental and fire safety issues, the choice of solvents is often limited. Open systems are still the most commonly used, but their appeal is shrinking with increasing demands for worker safety and health. Open systems include such approaches as solvent vapor degreasing, solvent, semi-aqueous or aqueous ultrasonic cleaning bathes, cold or hot aqueous or solvent dip tanks and aqueous or solvent spray systems. These systems suffer from a number of shortcomings, among the most important of which are the contamination of the environment and the cost of constantly replenishing the non-recoverable solvents. In addition, the cost of equipment to contain the vapor and to properly dispose of the vapor and liquid waste is becoming more and more formidable. There is also a rise in the concern for workers health and safety. All these factors give rise to the need for a more safe and effective process for the treatment of materials with harsh chemicals.

Unfortunately, many of the environmentally safe solvents that could be used as a processing fluid have a low flash point and become a fire and explosion hazard if used in most of the open systems mentioned above. Simply covering these systems does not suffice to prevent fires since this equipment have moving mechanical and electrical parts that can produce electrical or static sparks igniting the solvent vapor-air mixtures. The net result is that these systems generally depend upon fire suppression systems to provide safety to the equipment. These systems act as an end of line fire prevention method and are not attractive to today's end users. The closed systems available on the market today attempt to combat these problems but have indifferent success. Generally these systems mix air with the flammable solvent and provide little more fire protection then the open systems being used.

Thus, conventional chemical processing systems have problems in the area of hazardous fire prevention. They are generally limited to operating with solvents with no or high flashpoint. When using flammable solvents, the process is often limited to low temperatures for fire safety purposes A different approach is described here that avoids some of the problems of solvent processing. In this approach the processing solvent is exposed to only low-pressure environments in order to control and maintain oxygen level exposure to the solvent. Essentially the oxygen content at every stage and within every tank in the process is maintained at a concentration level where no fire or explosion could ignite or propagate. The method also provides for solvent recovery from the processing chamber and part thus preventing any solvent mixing with ambient air during or after part removal. The method will thus allow the usage of a wide variety of solvents for processing parts and provide for a more effective, safer process than presently available on the market today.

SUMMARY OF INVENTION

In general, the present invention is directed to a controlled environment processing chamber or chambers in which parts are to be chemically treated. The process includes a means of applying a negative gauge pressure to the chamber to remove air or other non-condensable gases. Means are provided for introducing a oxygen free solvent or aqueous solution in a vapor or liquid state. A first system removes oxygen and volatile contaminants from the object being processed and chamber, and a second system further recovers residual solvent from the object and chamber.

In another aspect of the invention, a method and system of processing an object in an enclosed solvent processing system, including a solvent supply system and separate solvent recovery system in sealable communication with an enclosed chamber comprises the steps of:

a) sealing the solvent or solution supply system with respect to the processing chamber;

b) evacuating the supply system of air and non condensable gases;

c) introducing nitrogen or another inert gas to return the supply tank to atmospheric pressure;

d) evacuating the supply system a second time to reduce the air content in the tank to create a low oxygen concentration in the supply system;

e) sealing the solvent holding tank with respect to the processing chamber;

f) evacuating the solvent holding tank of air and non condensable gases;

g) introducing nitrogen or another inert gas to return the solvent holding tank to atmospheric pressure and create a low oxygen concentration in the solvent holding tank;

h) opening the processing chamber to atmosphere and placing an object to be dried in the chamber;

i) sealing the processing chamber with respect to atmosphere;

j) evacuating the processing chamber to remove air and other non-condensable gases;

k) opening the processing chamber with respect to the solvent supply system and introducing a solvent or solution into the evacuated chamber;

l) processing the object while maintaining an air free environment within the chamber;

m) recovering and processing the solvent or solution introduced into the chamber within the closed circuit processing system;

n) sealing the processing chamber with respect to the solvent supply system closed circuit solvent processing system;

o) opening the processing chamber with respect to a closed circuit vapor recovery system;

p) recovering and processing solvent or solution residual liquid or vapors within the closed circuit vapor recovery system;

q) introducing nitrogen or another inert gas into the chamber for sweeping further solvent on the object and within the chamber while maintaining an air free environment within the chamber;

r) sealing the chamber with respect to the vapor recovery system;

s) introducing nitrogen or another inert gas into the chamber to return the chamber to atmospheric pressure; and t) opening the chamber and removing the treated object.

It is therefore an object of this invention to provide an improved closed circuit intrinsically safe solvent, aqueous or semi-aqueous processing method and system.

It is a further object of this invention to provide such an improved closed circuit intrinsically safe solvent, aqueous or semi-aqueous processing method and system that limits the air and thus oxygen from mixing with the solvent vapors to form a flammable solvent oxygen mixture.

It is a further object of this invention to provide such an improved closed circuit intrinsically safe solvent, aqueous or semi-aqueous processing method and system that enables solvent recovery and limits hazardous emissions.

It is a further object of this invention to provide such an improved closed circuit intrinsically safe solvent processing method and system that is operative at various temperatures to accommodate different objects to be treated and different solvents.

It is a further object of this invention to provide such an improved closed circuit intrinsically safe solvent processing method and system that is operative at various temperatures and pressures other than the boiling point at atmospheric pressure of the solvent used.

It is a further object of this invention to provide such an improved closed circuit intrinsically safe solvent processing method and system that dries the solvent off the object before venting to atmosphere.

It is a further object of this invention to provide such an improved closed circuit intrinsically safe solvent processing method and system that provides for surface treatment by condensation of vapor on parts causing a vapor wetting with clean solvent.

It is a further object of this invention to provide such an improved closed circuit intrinsically safe solvent processing method and system which uses much less solvent.

It is a further object of this invention to provide such an improved closed circuit intrinsically safe solvent processing method and system that employs internally generated differential pressures to drive the solvent through the system.

It is a further object of this invention to provide such an improved closed circuit intrinsically safe solvent processing method and system that is not restricted to operate with any particular solvent.

It is a further object of this invention to provide such an improved closed circuit intrinsically safe solvent processing method and system that virtually eliminates mixture of the solvent with air throughout the processing operation and eliminates the difficult step of separating the solvent from the air after the processing operation is completed.

It is a further object of this invention to provide such an improved closed circuit intrinsically safe solvent processing method and system that virtually eliminates the mixture of the solvent with air throughout the processing operation thus eliminating the oxygen required for deflagration and explosion.

The invention results from the realization that an efficient, economical, safe, environmentally sound solvent processing technique which is a truly closed operation can be effected, without the burden of having to separate the solvent from air after the cleaning operation, by evacuating a processing chamber containing parts to be cleaned before the solvent is introduced so that the solvent and air never meet, thus eliminating exposure to atmosphere. The airless solvent can then be easily extracted and condensed for reuse prior to the exposure of the chamber and parts to air during the removal of parts from the chamber after the processing operation has been completed.

This invention features and may suitably comprise, consist of, or consist essentially of a closed circuit solvent processing method comprising the steps of placing the object to be treated in a chamber and subjecting the chamber to a negative gauge pressure to remove air and other non-condensable gases. Following this, a solvent is introduced to the evacuated chamber and the object is treated. The solvent is then recovered from the object and chamber and the chamber is vented to atmosphere and the treated object is removed.

In a preferred embodiment the negative gauge pressure is in the range of 100 torr to zero atmospheric absolute. The solvent may be introduced in a vapor state or a liquid state, or both. The temperature of the chamber may be varied to control the temperature and vapor density of the solvent to increase or decrease the penetration of the solvent into the object to be treated and to create more or less pressure that can be used to drive the solvent through the closed system. Recovering the solvent includes withdrawing from the chamber the solvent in liquid state including the contaminants, and then drawing off from the chamber the solvent in the vapor state. Withdrawing the liquid solvent may include maintaining the chamber at an elevated temperature to generate increased pressure in the chamber and positively drive out the solvent in the liquid state with the contaminants. The drawing off of the solvent in the vapor state may include drying the object of solvent.

The invention also features an apparatus for accomplishing the technique of the invention including a closed solvent treatment system. There is a chamber for holding an object to be treated and means for applying a negative gauge pressure to the chamber to remove air and other non-condensable gases. There are also means for introducing to the chamber the solvent for cleaning the object and means for recovering the solvent from the object and chamber. Storage means stores the recovered solvent.

In a preferred embodiment, the chamber may include a heat exchanger for varying the temperature of the chamber. The means for applying a negative gauge pressure may include a vacuum pump and the means for introducing the solvent may include a valve means associated with the storage means. The means for recovering may include a drain for extracting the solvent liquid and contaminants and may include means for extracting the solvent vapor as well. The storage means may include one reservoir for receiving the solvent vapor and a second reservoir for receiving the solvent liquid, and there may be means for condensing the solvent vapor.

BRIEF DESCRIPTION OF DRAWINGS

The novel features which are characteristic of the intrinsically safe flammable solvent processing method and system are set forth below. However, the solvent processing method and system, together with further embodiments and attendant advantages, will be best understood by reference to the following detailed description taken in connection with the accompanying drawings in which.

DETAILED DESCRIPTION OF PREFERRED EMBODIMENT

This invention has been designed using the guidelines allowed in NFPA 69, Standard on Explosion Prevention Systems, 2002 Edition. Since the system will require high concentrations of combustible solvents to perform the processing steps, the main deflagration prevention method will be by oxidant concentration reduction.

Within this system the two major tanks containing solvent are all enclosed and are all operated under vacuum to ensure that these tanks are sealed and completely isolated from the ambient surroundings during operation, idling and shutdown. This type of system is allowed under Section 5.1 of NFPA 69 that states:

5.1 Application. The technique for oxidant concentration reduction for deflagration prevention shall be permitted to be considered where a mixture of oxidant and flammable material is confined to an enclosure within which the oxidant concentration can be controlled.

Section 5.1.1 states that:

5.1.1* The system shall be maintained at an oxidant concentration that is low enough to prevent a deflagration.

In this preferred embodiment, isopropyl alcohol (IPA) will be used as an example. NFPA 69 outlines the important design considerations for an intrinsically safe explosion prevention process. Section 5.2.1 states that:

5.2.1* Design Considerations. The following factors shall be considered in the design of a system intended to reduce the oxidant concentration 1) Required reduction in oxidant concentration 2) Variations in the process, process temperature and pressure, and materials being processed.

In the preferred embodiment, this invention is intrinsically safe during all phases of the process steps and for any solvent with a normal boiling point greater than 20° C. and any flash point. In the preferred embodiment every phase of the invention process will be addressed including installation to full operation.

Figure 1:
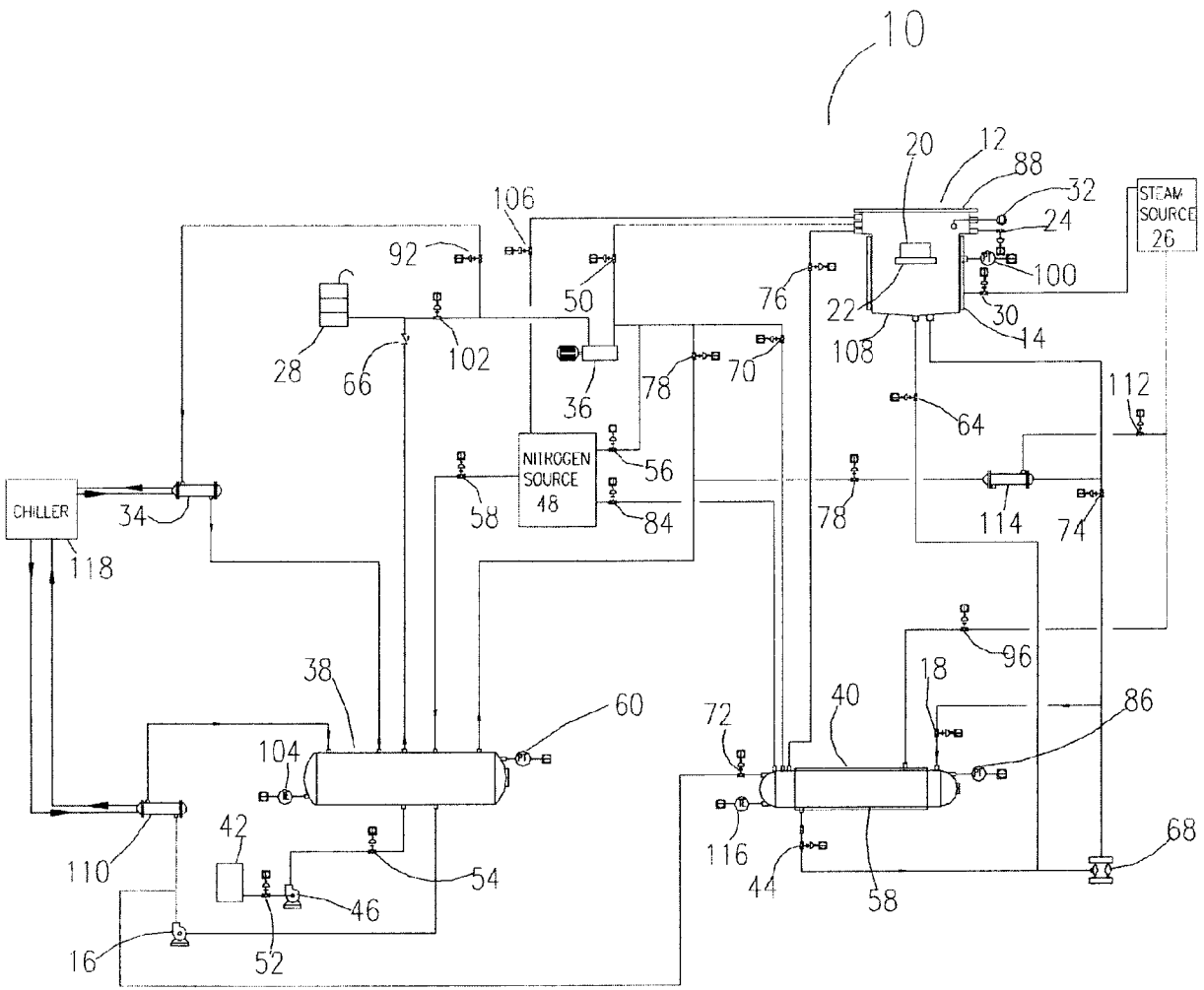
FIG. 1 is a schematic illustration of the intrinsically safe solvent processing system of the present invention.

Referring now to the drawings, the intrinsically safe solvent processing system of the present invention is illustrated and generally indicated at 10 in FIG. 1. In FIG. 1, the system 10 for implementing the teachings of this invention includes a main processing chamber generally indicated at 12 that may or may not be heated. The main processing chamber 12 includes a main body portion 108 and a lid 88. In the preferred embodiment, the main body portion 108 of the processing chamber 12 has a jacket 14 to accept steam from steam source 26 by opening valve 30 to introduce steam for heating. Other options for heating the chamber 12 include other heat transfer fluids, such as oil or hot water in an external jacket, plate coils or external pipe welded or soldered to the chamber or intrinsically safe electric heat blankets. The system 10 further includes a solvent source generally indicated at 42, a solvent holding tank generally indicated at 38, and a heated solvent vessel generally indicated at 58. Other component parts of the system 10 will be described in connection with operation thereof.

Preferred Method for Solvent Charging the System and Initiation of the System Solvent charging and preparation of the system for operation occurs after the initial installation of the equipment or following system maintenance that required solvent removal from the system. On startup of the process, the solvent holding tank 38 is charged with a preferred processing solvent or aqueous solution by a conventional charging mechanism, such as the pumping arrangement as depicted in FIG. 1. The charging mechanism as shown includes connecting valves 52 and 54 and an activating pump 46. Opening valves 54 and 52 and activating pump 46 charges the solvent holding vessel 38 to a volume needed to charge the complete system. During installation or following maintenance on the vessel 38, it should be assumed that the tank is completely filled with air. Pumping IPA into this vessel could result in a deflagration since the oxygen concentration at this point would be above the limiting oxygen concentration (LOC) listed by the NFPA 69 of 9.5 vol %.

In the preferred embodiment, the tank is first evacuated to less than 25 torr prior to introduction of solvent by activating vacuum pump 36, and opening valves 78 and 102. In the preferred embodiment, an intrinsically safe multistage dry vacuum pump is preferred, however other types of vacuum pumps such as pneumatic venturi type vacuum pumps, liquid ring vacuum pumps, cryogen pumps, diaphragm or constant displacement pumps or inert gas purged oil ring pumps could be used. The vacuum level in the holding tank 38 is monitored by pressure transducer 60 to assure vacuum levels are attained. The exhaust from the pump can be sent directly to atmosphere however in the preferred embodiment this stream is sent to a gas scrubber such as an absorber, spray washer or as shown in FIG. 1 an activated carbon drum 28. If required, an inert gas can be added to the inlet stream to lower the inlet oxygen concentration such as shown in FIG. 1 by adding nitrogen from nitrogen source 48 by opening valve 56.

The tank is then filled with nitrogen to atmospheric pressure by opening valve 58 connected to nitrogen source 48. The actual oxygen concentration (AOC) at this point is:

$$AOC = \frac{P_{o2}}{P_T} = \frac{25 \times 0.21}{760} = 0.007 vol - frac$$

where:

$P_{O2}$=Partial pressure of oxygen in torr $P_T$=Total pressure in the process fluid tank in torr The above process is allowed in NFPA 69 under 5.7.2.7.2.

5.7.2.7.2 The procedure of pulling a partial vacuum and then breaking the vacuum with inert gas shall be permitted without measuring the oxygen concentration if all of the following apply:

1. The vacuum condition is held for a time to check for leakage.
2. The vacuum level is monitored.
3. The vacuum-creating medium is compatible with the process chemistry.
4. The residual oxygen partial pressure is calculated or demonstrated by test to be at least 40 percent below the LOC.

The NFPA lists the limiting oxygen concentration (LOC) for IPA as 9.5-volume % oxygen. As required in section 5.7.2.7.2, a 9.5 vol % LOC to be in compliance with section 5.7.2.7.2 (4) requires an AOC of:

$$AOC(\text{REQUIRED})=9.5\times0.6=5.7\text{ vol }\%$$

The calculated AOC of 0.7% is allowed.

Upon filling holding tank 38 with nitrogen, the tank can be charged with solvent as described above. Excess nitrogen pressure attained in holding tank 38 during solvent filling, can be vented through pressure relief valve 66 and excess solvent in the purge stream can be stripped from the nitrogen by scrubber 28.

Upon filling the solvent holding tank 38, the heated solvent vessel 58 is evacuated by opening valves 70 and 102 and activating vacuum pump 36. As done with the holding tank, the vacuum level, as monitored by pressure transducer 86, is reduced to 25 torr. Refilling vessel 58 with nitrogen from nitrogen source 48 by opening valve 84, reduces the actual oxygen content in vessel 58 to 0.7%. The heated solvent tank is then again evacuated to 25 torr by opening valves 70 and 102 and activating vacuum pump 36. Clean solvent can now be introduced to the heated solvent vessel 58 by activating circulation pump 16 and opening valve 72. Upon filling the heated solvent vessel 58, the solvent in the vessel 58 is heated to the desired operating temperature that is below the solvent's normal boiling point (NBP). In the preferred embodiment, a steam-heated jacket 40 filled with steam from steam source 26 by opening valve 96 is used. By heating the solvent below the NBP, the vessel 58 will be at a negative gauge pressure. Any leaks in the vessel fittings or gaskets will register a higher pressure than the vapor pressure of the solvent on the pressure transducer 86 and the system can be shutdown before leakage to the environment occurs. Operating above the NBP can be allowed however vapor sensors external to the vessels and deflagration extinguishing system should be employed.

Preferred Method for Performing a Cold Startup of the Unit

A cold startup of the system would be the more common operation where tanks 38 and 58 are filled with solvent at room temperature. Initially the tanks are assumed filled with air and solvent. The tanks are first evacuated to less than 200 torr as described above. The tanks are then filled with nitrogen to atmospheric pressure as described above. The heated solvent tank 58 is again pumped to 200 torr or less. Assuming the tanks to be at 65 F (worst case scenario), as monitored by temperature elements 104 and 116, from FIG. 2 the vapor pressure of the solvent isopropyl alcohol would be 35 torr. The actual oxygen concentration (AOC) after nitrogen introduction to either the solvent holding tank or the heated solvent tank would be:

$$AOC=\frac{P_{o2}}{P_T}=\frac{(200-35)\times0.21}{760}=0.046vol\cdot frac$$

The AOC after reducing the pressure in the heated solvent tank a second time would be:

$$AOC=\frac{P_{o2}}{P_T}=\frac{(200-35)\times0.046}{200}=0.038vol\cdot frac$$

The calculated AOCs of 4.6 vol % and 3.8 vol % are allowed under NFPA 69 Standards.

Preferred Method for Operating the Unit in a Processing Mode

During a processing operation, after a part 20 is placed on a holder 22 in the processing tank and the lid 88 is closed and secured, the processing chamber 12 is pumped down to a pressure of 25 torr or less by opening valves 50 and 102 and activating vacuum pump 36. Upon reaching the desired pressure, valves 50 and 102 are closed and pump 36 is deactivated.

Figure 2:
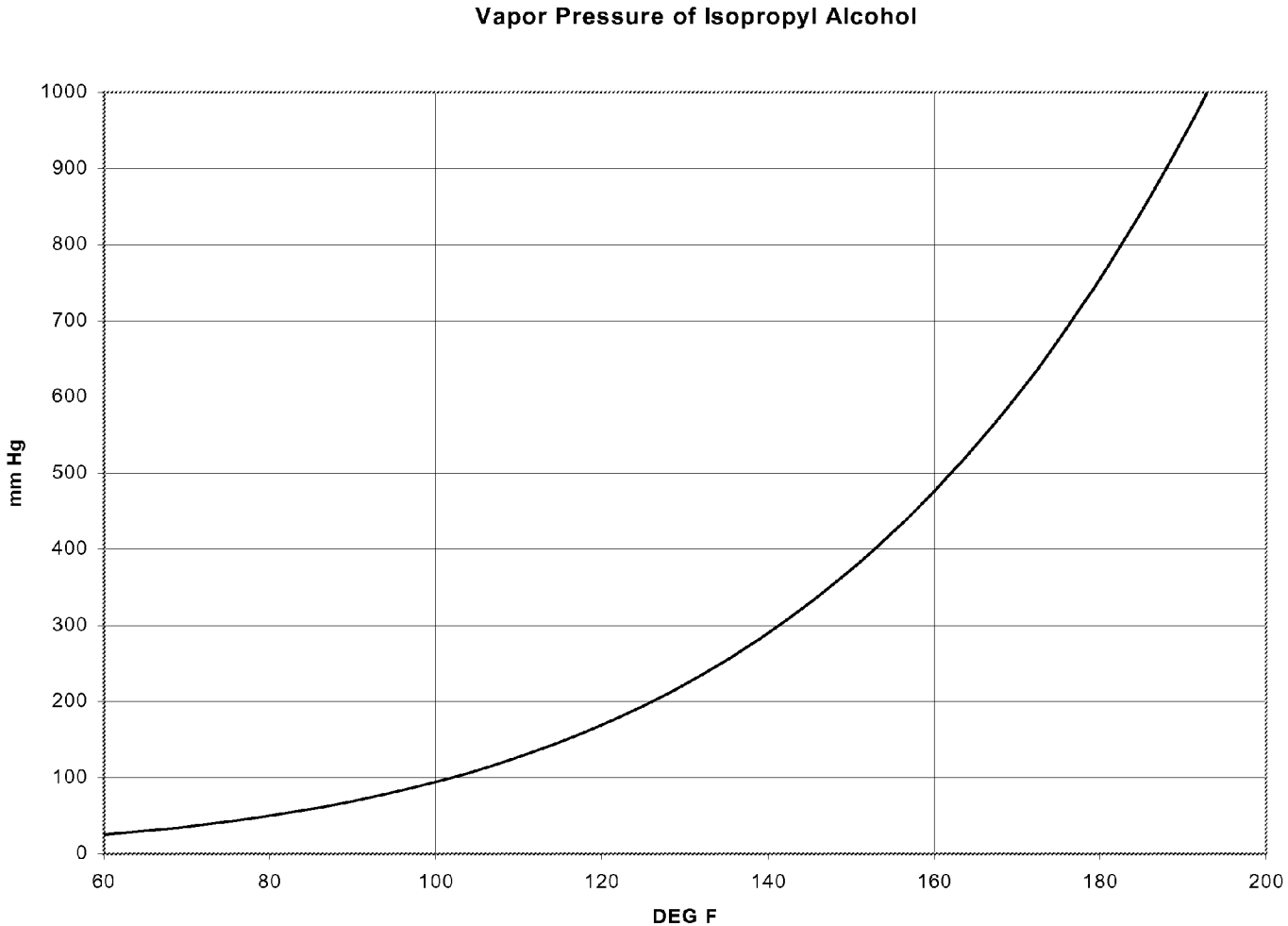
FIG. 2 is a graph depicting the vapor pressure of the solvent isopropyl alcohol.

The processing chamber 12 is then filled with solvent vapors by opening valve 76 and allowing vapors to flow from heated vessel 58 into the processing chamber. The pressure in the processing chamber should rise near the pressure in the heated solvent tank 58 and the pressure is monitored with pressure transducer 100. In the preferred embodiment, this pressure is kept below 760 torr to assure that no leakage to the environment that could create a flammable air solvent mixture outside of the system 10. In this example a pressure of 600 torr in the heated solvent vessel 58 will be used. In a gas free enclosed environment, a heated solvent will pressurize to its vapor pressure. FIG. 2 shows a vapor pressure curve for IPA. As seen in the figure if the temperature in heated solvent tank 58 is kept below 170° F., as monitored by temperature element 116 in the heated solvent tank, the pressure should not rise above 600 torr. Assuming the processing chamber 12 was initially evacuated to 25 torr as described above, the highest oxygen content in the processing chamber 12 at this point would be:

$$AOC=\frac{P_{o2}}{P_T}=\frac{25\times0.21}{600}=0.009vol\cdot frac$$

If any air leaks occurred in the processing chamber 12, the increase in pressure would be detected by pressure transducer 100 and valves 50 and 92 would be opened and vacuum pump 36 activated and the vapor-air mixture would be sent to condenser 34 to be cooled and partially liquefied and then sent to holding tank 38. Since the vapor pressure of the heated solvent in processing chamber 12 would remain constant, the change in pressure would be due to the reduction in the partial pressure of air in the chamber. Under a worst-case scenario, this chamber could leak air into the chamber and if the chamber pressure rises to 700 torr, sending some vapor air mixture to a condenser and then the clean fluid tank reduces the pressure. The maximum oxygen concentration in the processing chamber 12 that could result from air leakage would then be:

$$AOC=\frac{P_{o2}}{P_T}=\frac{(700-600)\times0.21}{700}=0.03vol\cdot frac$$

This is allowable under section 5.7.2.7 of the NFPA Standard 69.

In the preferred embodiment, the processing fluid is next introduced to the cleaning chamber 12 from the processing fluid supply tank 58 as a heated liquid soak through pump 68 and valves 44 and 74. Typically the processing fluid is introduced to processing chamber 12 until liquid level sensor 32 is activated and then valves 44 and 74 are closed and pump 68 is turned off.

After the object 20 has been processed, any liquid solvent remaining in the processing chamber 12 is drained and/or pumped into the heated fluid solvent vessel 58 by opening valves 64 and 18 and activating pump 68. The drained liquid will also remove most of the chips or insoluble material, if present, and transfer them also to the heated solvent vessel 58.

Solvent vapors are next removed from the cleaning chamber 12 by means of a solvent handling vacuum pump 36. Specifically valves 50 and 92 are opened and vacuum pump 36 is activated and since there is no air present in this system, solvent vapors can be easily condensed in a heat exchanger 34 and the clean condensed solvent can be sent to the clean fluid holding tank 38 to be stored for reuse as clean solvent for future processing cycles. During this vapor-scavenging step, any residual solvent liquid remaining on the heated part 20 or chamber 12 walls boils off at the lower vacuum pressures, thus reducing solvent residual left in the vessel or on the part.

Enhanced drying can be attained by opening valve 78 and allowing an inert gas-vapor mixture from clean fluid holding tank 38 to first be heated by heater 114 and passed through chamber 12. Heater 114 in the preferred embodiment is a heat exchanger heated with steam from steam source 26 by opening valve 112. The drying gas and solvent are circulated back to holding tank 38 through valve 50, vacuum pump 36, valve 92 and chilled in heat exchanger 34. Heat exchanger 34 can be cooled by a chiller 116 or with any other type of cooling medium such as city or cooling tower water. Excess heat from the condensing vapor can be removed from the clean fluid in the holding tank 38 by circulating fluid through heat exchanger 110 by activating circulation pump 16.

Upon removal of solvent vapor and liquid from the processing chamber 12, the chamber 12 is then returned to atmospheric pressure by introducing nitrogen from nitrogen source 48 through valve 106. Depending upon the vacuum level attained in the vapor-scavenging step, the processing chamber 12 may contain residual solvent vapors, which can be removed by evacuating the chamber 12 through valves 50 and 102 using the vacuum pump 36. Collecting residual solvent in activated carbon filter 26 or in scrubbers or other conventional solvent gas stripping processes can treat the effluent nitrogen stream. This introduction of nitrogen followed by purging the processing chamber 12 can be repeated as many times as necessary prior to opening the processing chamber 12 and removing the processed article 20. In the preferred embodiment, ambient air can be introduced to the chamber 12 by opening valve 24 to return the chamber to atmospheric pressure and the processed article 20 can be removed from the chamber 12 after opening chamber lid 88, or additional processing steps can be performed since the chamber 12 at this point is completely void of air and chemicals.

What is claimed is:

1. A method of treating an object in a closed solvent processing system, said system including a processing chamber, said object being disposed in said processing chamber, said system further comprising a process fluid supply system in communication with said processing chamber, said solvent comprising a flammable solvent, said method comprising the steps of: sealing the process fluid supply system with respect to the chamber; evacuating the process fluid supply system gases to establish a low oxygen environment within the process fluid supply system; introducing an inert gas to said process fluid supply system to return the process fluid supply system to atmospheric pressure; evacuating the process fluid supply system a second time to reduce the oxygen content in the process fluid supply system to create a low oxygen concentration in the process fluid supply system; sealing the processing chamber with respect to the surroundings; applying a negative gauge pressure to the processing chamber to remove non-condensable gases; opening the processing chamber with respect to the fluid supply system and introducing a process fluid into the evacuated processing chamber; processing the object within the chamber while maintaining a low oxygen environment within the chamber; recovering and processing the process fluid introduced into the processing chamber within the closed circuit processing system; sealing the processing chamber with respect to the process fluid supply system; opening the processing chamber with respect to a closed circuit vapor recovery system; recovering and processing the process fluid residual liquid and vapors; introducing an inert gas into the processing chamber for sweeping further process fluids and vapors on the object and within the chamber while maintaining a low oxygen environment within the processing chamber; sealing the processing chamber with respect to a vapor recovery system; introducing an inert gas into the processing chamber to return the processing chamber to atmospheric pressure; and opening the processing chamber and removing the treated object.

2. The method of claim 1 wherein said process fluid is selected from the group comprising: organic solvents, aqueous solutions, and semi-aqueous solutions.

3. The method of claim 1 wherein said step of evacuating the process fluid supply system comprises reducing the pressure in the processing fluid supply system to a pressure within the range of atmospheric pressure to zero absolute pressure.

4. The method of claim 1, wherein the step of introducing said inert gas to the process fluid supply system reduces the oxygen concentration in said process fluid supply system to concentration levels below the limiting oxygen concentration.

5. The method of claim 1 wherein said negative gauge pressure applied to said processing chamber is in the range of atmospheric pressure to zero absolute pressure.

6. The method of claim 1, wherein said step of introducing said process fluid to the processing chamber comprises introducing said process fluid in a form selected from the group comprising a liquid spray, a liquid soak, a vapor, a gas-vapor mixture, and an aerosol spray.

7. The method of claim 1, wherein said step of recovering the processing fluid from the object and the chamber includes withdrawing the process fluid in a liquid state.

8. The method of claim 1, wherein the step of recovering the residual process fluid liquid and process fluid vapors from the processing chamber includes reducing the pressure in the processing chamber to flash the process fluid from the object and the chamber and withdrawing the process fluid as a vapor from the chamber.

9. The method of claim 1, wherein said step of recovering the residual process fluid liquid and process fluid vapor from the processing chamber includes circulating a superheated vapor in a closed loop from said process fluid supply system to the processing chamber and then to a clean fluid holding system to dry the object and sweep the processing chamber of process fluid vapor.

10. The method of claim 1, wherein the step of recovering the residual process fluid liquid and process fluid vapor from the processing chamber includes circulating an unsaturated inert gas-vapor mixture in a closed loop from a clean fluid holding system to the processing chamber and then back to the clean fluid holding system to dry the object and sweep the processing chamber of process fluid vapor.

11. The method of claim 10 wherein said clean fluid holding system includes a sealed tank filled with an inert gas by first evacuating the clean fluid holding system of non-condensable gases and then introducing said inert gas to return the clean fluid holding system to atmospheric pressure and create a low oxygen concentration in the clean fluid holding system.

12. The method of claim 11 wherein said step of evacuating the clean fluid holding system includes reducing the pressure in the clean fluid holding system to a pressure within the range of atmospheric pressure to zero absolute pressure.

13. The method of claim 11 wherein said step of introducing said inert gas to the clean fluid holding system reduces the oxygen concentration in said clean fluid holding system to concentration levels below the limiting oxygen concentration.

* * * * *